US011131124B2

(12) United States Patent
Hunt et al.

(10) Patent No.: US 11,131,124 B2
(45) Date of Patent: Sep. 28, 2021

(54) OPENING DEVICE WITH LOCKING DEVICE FOR A MOTOR VEHICLE LATCH

(71) Applicant: Kiekert AG, Heiligenhaus (DE)

(72) Inventors: Robert J. Hunt, Davisburg, MI (US); Robert S. Pettengill, Farmington, MI (US); Thorsten Nottebaum, Mühltal (DE)

(73) Assignee: Kiekert AG, Heiligenhaus (DE)

( * ) Notice: Subject to any disclaimer, the term of this patent is extended or adjusted under 35 U.S.C. 154(b) by 572 days.

(21) Appl. No.: 16/085,233

(22) PCT Filed: Mar. 6, 2017

(86) PCT No.: PCT/IB2017/000203
§ 371 (c)(1),
(2) Date: Sep. 14, 2018

(87) PCT Pub. No.: WO2017/158416
PCT Pub. Date: Sep. 21, 2017

(65) Prior Publication Data

US 2020/0332568 A1 Oct. 22, 2020

Related U.S. Application Data

(60) Provisional application No. 62/309,017, filed on Mar. 16, 2016.

(51) Int. Cl.
*E05B 77/06* (2014.01)
*E05B 77/02* (2014.01)
(Continued)

(52) U.S. Cl.
CPC ..... *E05B 77/06* (2013.01); *E05B 77/02* (2013.01); *E05B 77/04* (2013.01); *E05B 77/12* (2013.01)

(58) Field of Classification Search
CPC ..... E05B 77/06; E05B 77/02; E05B 77/04; Y10T 292/03; Y10T 292/22; Y10S 292/22
See application file for complete search history.

(56) References Cited

U.S. PATENT DOCUMENTS 8,857,866 B2 * 10/2014 Savant ..... E05B 77/06 292/336.3
9,920,555 B2 3/2018 Brickner et al.
2014/0312630 A1 * 10/2014 Bendel ..... E05B 85/10 292/195

FOREIGN PATENT DOCUMENTS

DE 102008060465 5/2010
DE 202011106661 1/2013
(Continued)

OTHER PUBLICATIONS

International Search Report and Written Opinion for corresponding Patent Application No. PCT/IB2017/000203 dated May 23, 2017.

*Primary Examiner* — Kristina R Fulton
*Assistant Examiner* — James Edward Ignaczewski
(74) *Attorney, Agent, or Firm* — Renner, Otto, Boisselle & Sklar, LLP

(57) ABSTRACT

An opening device for a motor vehicle latch with a trigger which can be moved from a starting position into an opening position for pivoting of a triggering lever from a starting position into an opening position and which is connected with an inertia component by a deflectable knee lever, with a blockade lever, which can be moved by deflection of the knee lever from a starting position into a blocking position, whereby the movement of the triggering lever into the opening position is prevented when the blockade lever is in its blocking position, whereby the knee lever is deflected by excessive acceleration of the trigger and the blockade lever is thus moved into its blocking position.

19 Claims, 3 Drawing Sheets

Figure 1:
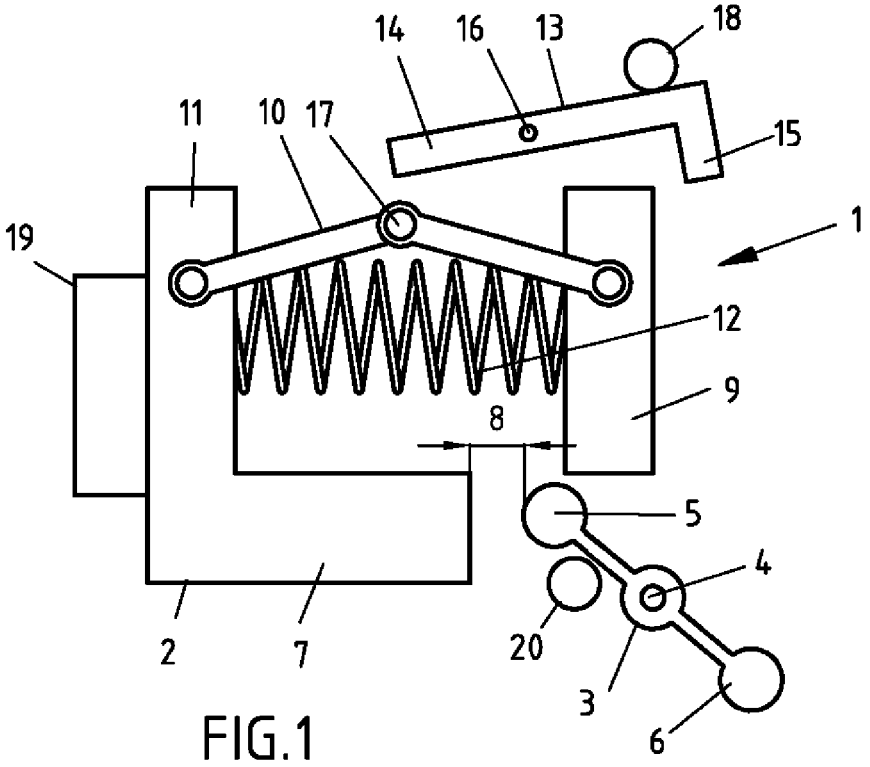

(51) Int. Cl.
*E05B 77/04* (2014.01)
*E05B 77/12* (2014.01)

(56) References Cited

FOREIGN PATENT DOCUMENTS

| | | | | | |
|---|---|---|---|---|---|
| DE | 102014001123 | | 7/2015 | | |
| DE | 102014205647 | | 10/2015 | | |
| DE | 102014205647 | A1 * | 10/2015 | ..... | E05B 77/06 |
| DE | 102015001318 | A1 * | 8/2016 | ..... | E05B 77/06 |
| DE | 102017103472 | A1 * | 8/2018 | ..... | E05B 77/06 |
| EP | 01518983 | | 3/2005 | | |

* cited by examiner

OPENING DEVICE WITH LOCKING DEVICE FOR A MOTOR VEHICLE LATCH

RELATED APPLICATION DATA

This application claims the benefit of U.S. Provisional Application No. 62/309017 filed on Mar. 16, 2016, the content of which is incorporated herein by reference.

The invention relates to an opening device with a locking device for a motor vehicle latch. A motor vehicle latch demonstrates a locking mechanism, which comprises a catch and a pawl for latching of the catch in a locking position. The locking device blocks the opening mechanism dependent on acceleration forces occurring. If an opening device of the lock is activated with sufficiently low acceleration, the locking mechanism opens. If the opening device is activated with excessive acceleration, the locking device prevents opening of the latch.

An opening device has a triggering lever which is pivoted so that the catch can leave its locking position and the latch can thus be opened. Such a triggering lever is regularly associated with a door handle or flap. This can be an external or internal handle of a relevant door or flap. If such a handle is activated, the triggering lever is activated or pivoted to unlock the locking mechanism and thus to open the latch.

In the event of an accident or a vehicle collision, also known as a crash, very high accelerations usually occur suddenly which can be a multiple of gravitational acceleration. Thus the relevant latch, including the lever system, such as the handle of a door or flap, is exposed to considerable force of the motor vehicle which can lead to an unwanted opening of the locking mechanism and consequently an opening of the pertaining latch. In a crash, for example, an internal or external door handle can be activated inadvertently through acceleration or deformation.

If a latch can open inadvertently, this causes considerable danger to vehicle users. Because an open motor vehicle door can no longer provide the safety devices present in it, such as a lateral airbag or lateral impact protection for the protection of the vehicle occupants. A locking device aims to ensure that such a latch does not open inadvertently in a crash.

In accordance with the pamphlet EP 01 518 983 A2 a latch is equipped with a locking mechanism and a locking device which comprises at least an activation lever for triggering or opening of the locking mechanism. Furthermore, the latch demonstrates an inertia component which blocks the activation lever in prescribed cases of excessive acceleration to prevent inadvertent opening. In the event of a crash, following the excessive acceleration arising during the impact, a rebound effect can follow which is also known as bounce. Due to a delayed or repeated rebound effect, in particular combined with changes to the forces and directions of acceleration, such a locking device can fail at great accelerations and a locking mechanism can open inadvertently.

From the pamphlet DE 10 2014 001 123 A1 a motor vehicle latch with a locking device is known in which inadvertent opening can be safely prevented if rebound effects occur in the event of a crash.

It is the task of the invention to provide a reliable locking device for a motor vehicle lock. Because of the small time frame measured in testing it is considered preferable to have the locking mechanism exist in the blocking state in preparation for such an event. Only being moved out of the way by slow purposeful operation of the trigger. Due to the object of the present invention a latch should preferably also be able to be provided which also requires a small installation space with high functional safety, only comprises few components and consequently is simple to install.

The task of the invention is solved by the object of the first claim. Advantageous designs result from the dependent claims.

The opening device comprises a movably mounted trigger. The trigger can be moved from a starting position into an opening position and back again in order by movement into the opening position to be able to move a triggering lever from a starting position into an opening position in order to thus open a locking mechanism of a motor vehicle latch. The trigger is connected to an inertia component by an elastic link. The connection includes a blockade lever which utilizes relative movement between the trigger and the inertia component. The blockade lever insures the inertia component remains in the blocking position through the rebounding measured after the initial impact of the high acceleration blocking.

The blockade lever which can be moved by deflection of a knee lever or direct contact from the trigger or inertia component dependent on the location of the blockade lever pivot. The U.S. Pat. No. 13,744,934 depicts the blockade lever pivoted on the inertia component and directly acted on by the trigger. The blockade lever is moved from a starting position into a blocking position. If the blockade lever is in its blocking position, the inertia component cannot be moved into its opening position to unblock the locking mechanism. This restrains the inertia component in the blocking position until the rebounding has ceased determined by the trigger resetting at or near zero position. If the blockade lever is in its starting position, the inertia component can be moved by the triggering lever into its unblocking position to open the locking mechanism.

The trigger and the inertia component are connected to one another in such a way that with sufficiently low acceleration the trigger and the inertia component are moved together like a rigid body. With excessive acceleration of the trigger, a relative movement takes place between the trigger and the inertia component. By means of this, the blockade lever is moved into its blocking position directly or through a linkage. A pertaining locking mechanism of a motor vehicle latch can then no longer be opened.

In a configuration of the invention, the connection between the trigger and the inertia component is elastic. The elastic connection enables a relative movement on the one hand. On the other hand, the elastic connection ensures that, with an absence of external exertion of force, a prescribed distance is complied with or reproduced between the trigger and the inertia component. Thus, the knee lever can be created in such a way that this can be elastically deflected from its starting position.

The elastic connection is achieved by a spring in particular which is preferably made of metal for stability reasons.

The spring is preferably a spiral spring. One end of the spring can be attached to the trigger. The other end of the spring can be attached to the inertia component. A spring attached in such a way contributes to reliable holding and storage of the inertia component.

The inertia component is arranged in an advantageous configuration in such a way that it blocks activation of the triggering lever when the trigger is in its starting position. The inertia component can only be moved out of its blocking position by movement of the trigger, namely if the trigger is accelerated with sufficient slowness. With excessive acceleration, a relative movement takes place between the trigger and the inertia component. Consequently, the inertia component remains in its starting position and thus in its blocking position. Furthermore, the blockade lever is then moved into its blocking position by means of the knee lever. In this blocking position, the blockade lever blocks the inertia component in such a way that this cannot be moved out of its blocking position. This configuration prevents the triggering lever being inadvertently activated for opening of a pertaining locking mechanism by the rebound effect. In this configuration, the blockade lever indirectly prevents the triggering lever being moved into its opening position in order to open the locking mechanism.

The inertia component can, for example, be held and conducted by guides such as one or several rails or constrained radially about a pivot.

In an advantageous design, the inertia component is solely held by the connection to the trigger. There are therefore no other elements or components by means of which the inertia component is held in order to thus minimize the number of components. The guides are also superfluous.

In a configuration, the trigger can be moved in a linear manner in order to thus minimize installation space. The trigger can therefore be moved linearly backwards and forwards between the starting position and the triggering position. Installation space can thus be saved compared to pivoting movements.

In a configuration of the invention, the trigger demonstrates two arms which in particular are connected at a right angle or predominantly at a right angle. The knee lever is attached to an arm. Preferably one end of a spring is also attached to this arm. The other arm stretches in the direction of the triggering lever. The triggering lever can be activated to open the locking mechanism with the other arm. This configuration contributes to being able to manufacture the locking device especially compactly with little installation space.

In a configuration, the blockade lever demonstrates two arms which are preferably connected at a right angle or predominantly at a right angle. One arm comprises an axis and is pivotably stored and can be detected and pivoted by the knee lever. The other arm can be blocked in such a way that activation of the triggering lever can be directly or indirectly prevented. This configuration of the blockade lever advantageously contributes to a compact, small design.

In one configuration, there is a pre-tensioned spring which keeps the blockade lever in its starting position. The pre-tensioned spring also ensures that the blockade lever can be moved back to its starting position by spring force.

In one configuration, there is a stop for the blockade lever. If the blockade lever is adjacent to the stop, the blockade lever is in its starting position. Functional safety is thus further improved.

In one configuration, there is a distance in the starting position of the triggering device and thus an empty path between the knee lever and the blockade lever when the trigger is in its starting position. Deflection of the knee lever then does not immediately cause pivoting of the blockade lever because the empty path must first be traversed. Only when a prescribed acceleration is exceeded does a relative movement take place between the trigger and the inertia component which traverse the empty path, the blockade lever is then grasped by the knee lever and is subsequently moved into its blocking position. This configuration contributes to a desired functioning in an improved manner.

There is such an empty path in the starting position of the triggering device preferably also between the trigger and the triggering lever in order to improve the desired functioning.

In one configuration, both arms of the knee lever include an angle of less than 180°, preferably less than 170° and preferably more than 140° in the starting position in order to enable an especially compact and small design.

In one configuration, the aforementioned angle decreases when the trigger is accelerated with excessive speed. This also contributes in an improved manner to an especially compact and small design. However, in principle it is also possible for the aforementioned angle to increase with excessive acceleration, hence the knee lever being brought into an elongated form and deflected in this sense and the blockade lever thus moved into its blocking position.

The opening device is in particular created in such a way that following excessive acceleration the opening device needs to be returned to its starting position before a motor vehicle latch can be systematically opened. This configuration ensures with particular reliability that excessive acceleration cannot cause inadvertent opening of a motor vehicle latch. In a further preferred configuration the inertia component must be moved out of its blocking starting position for opening in a straight line in the opening direction and back in the opposite direction into its starting position in order that it can be opened again following a crash. This also supports a very reliable functioning of the locking device. The blockade lever must preferably only block spring forces and no forces caused by a crash. This also contributes to the locking device operating very safely and in the desired manner.

Linear movements are not absolutely necessary in any case. It is also possible that, for example, the inertia component is not moved linearly, i.e. in a straight line, but rotates around an axis in order to go from a starting position into the opening position and back. This can have the advantage that the inertia component is accelerated in a different direction compared to the acceleration occurring due to an accident.

The larger the mass of the inertia component, the greater the spring force in the event of a connection between the trigger and the inertia component. Larger spring forces have the advantage that the tolerances to be complied with are low.

The spring is advantageously not exposed to any frictional forces which also contributes to especially safe operation.

In one configuration, the blockade lever is directly pivotably attached to the inertia component. This also contributes to an especially simple construction.

The components of the opening device must not demonstrate complex geometry and can therefore be manufactured at low technical expense.

The invention also enables the provision of a relatively small inertia component compared to solutions known from the state of the art.

Figure 2:
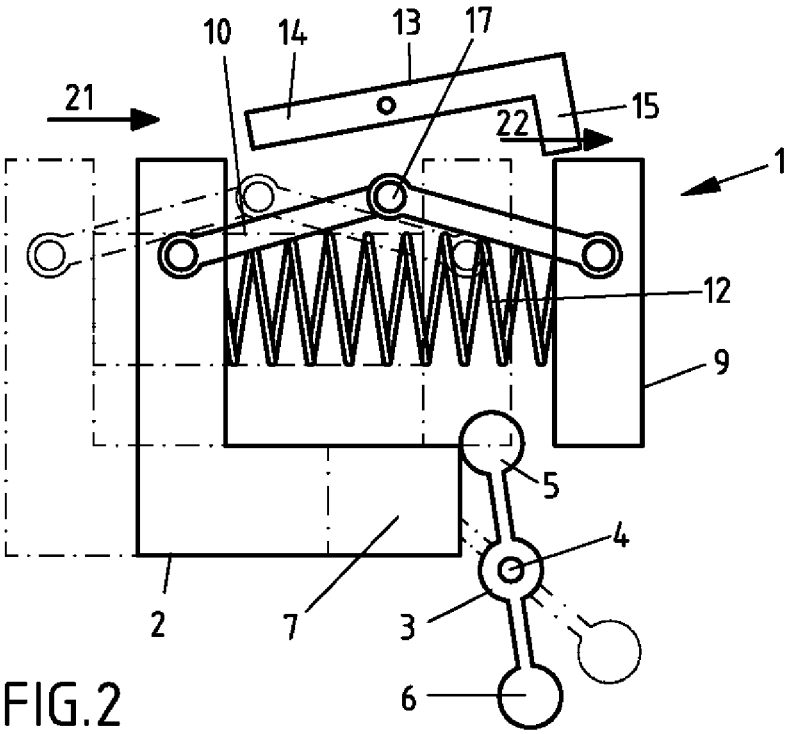
Figure 3:
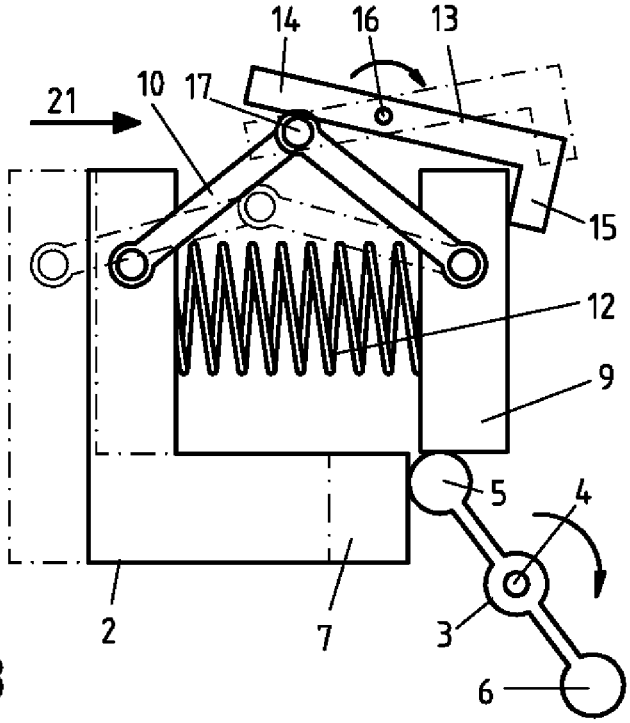
Figure 4:
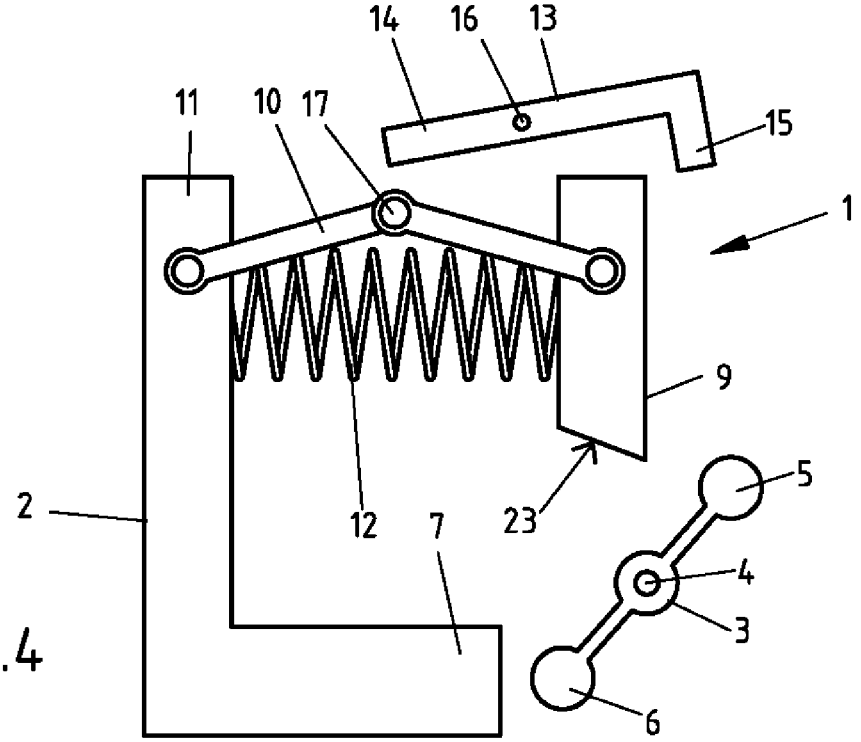
Figure 5:
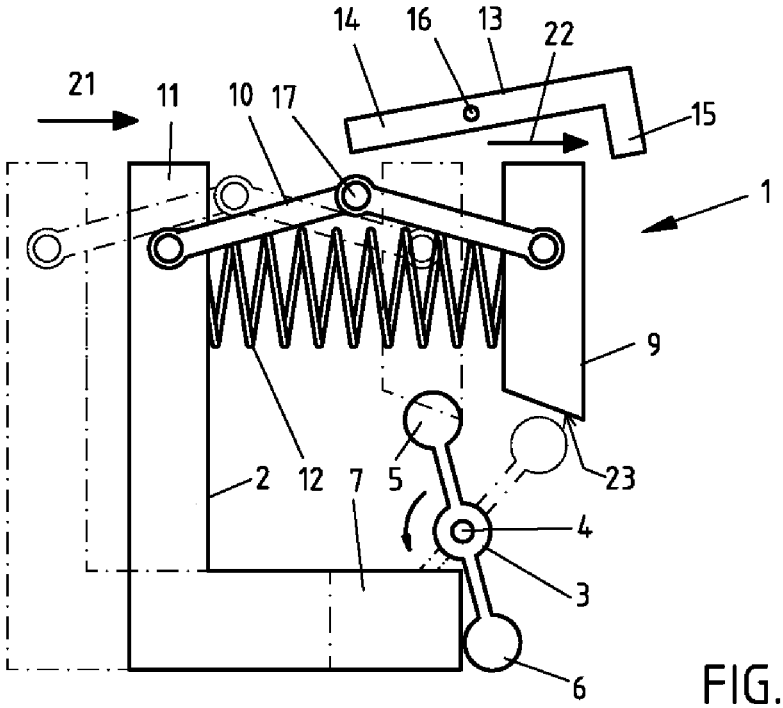
Figure 6:
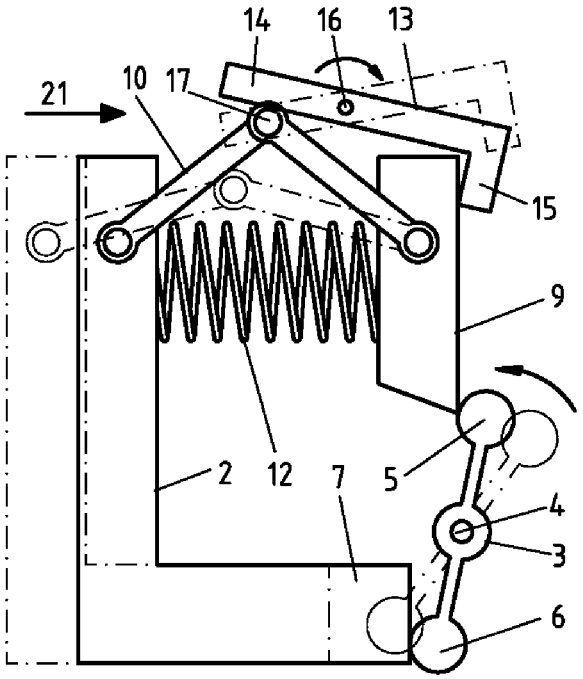

The following are shown:

FIG. 1: Starting position of an opening device in accordance with a first execution form;

FIG. 2: Open position of the opening device in accordance with the first execution form;

FIG. 3: Blocked position of the opening device in accordance with the first execution form;

FIG. 4: Starting position of an opening device in accordance with a second execution form;

FIG. 5: Open position of the opening device in accordance with the second execution form;

FIG. 6: Blocked position of the opening device in accordance with the second execution form;

FIG. 1 shows a first especially small opening device 1 for a locking mechanism of a motor vehicle latch. The opening device 1 comprises a movable trigger 2, with which a non-illustrated locking mechanism of a motor vehicle latch can be opened. Trigger 2 can be moved in a linear manner from the starting position shown in FIG. 1 to an opening position and back in order to activate the triggering lever 3 by movement into the opening position. The trigger 2 is therefore pivotable.

The trigger lever 3 is pivotable around an axis 4 and demonstrates two arms 5 and 6. If the triggering device is activated, the trigger 2 is thus moved out of its starting position, namely in the direction of the triggering lever 3. The trigger 2 comprises an arm 7, with which the triggering lever 3 can be pivoted around the axis 4 for an opening of the locking mechanism in a clockwise direction. In the starting position shown in FIG. 1 there is an empty path 8 between the arm 7 of the trigger 2 and the triggering lever 3 or its arm 5 for especially reliable operation. If the trigger 2 has been moved along the empty path 8 by activation, the free end of the arm 7 of the trigger 2 reaches or grasps the end of the arm 5 of the triggering lever 3. If an exceeding continuation of the movement of the trigger 2 is not blocked, the triggering lever 3 is then pivoted in a clockwise direction. As a result of the associated pivoting of the other arm 6 of the triggering lever 3 a pertaining locking mechanism is then opened. Thus, the pivoting of the arm 6 of the triggering lever 3 for example can grasp a pawl of a pertaining locking mechanism and move it out of its locking position. Subsequently, the catch of the locking mechanism can be moved out of its locking position and the latch thus opened.

The trigger 2 is connected to an inertia component 9. The inertia component 9 preferably consists of a heavy material such as metal in order to provide sufficiently heavy weight with a small installation space. The form of the inertia component 9 can be very simple. A body with rectangular and/or quadratic lateral surfaces is thus sufficient. The inertia component 9 can therefore be a cuboid, for example.

In the starting position shown in FIG. 1 pivoting of the triggering lever 3 in a clockwise direction causes the arm 5 of the triggering lever 3 to be moved against the inertia component 9 preferably only after traversing a short empty path shown in FIG. 1. The inertia component 9 then blocks a further pivoting of the triggering lever 3 in a clockwise direction and thus opening of a pertaining locking mechanism. Activation for opening of a locking mechanism is therefore not then possible. It is therefore necessary to move the inertia component 9 out of its blocking position in order to be able to open a locking mechanism. Such a movement out is only possible if the trigger 2 is moved with sufficiently low acceleration from its starting position in the direction of the triggering position, therefore in the direction of the triggering lever 3.

The connection between the trigger 2 and the inertia component 9 comprises a knee lever 10 which permits a relative movement between the trigger 2 and the inertia component 9. In the case of relative movement the knee lever 10 is deflected. One end of the knee lever 10 is flexibly connected with an arm 11 of the trigger 2 and the other end with the inertia component 9.

The connection between the trigger 2 and the inertia component 9 also comprises a spiral spring 12 which also permits a relative movement between the trigger 2 and the inertia component 9. One end of the spring is connected to the arm 12 of the trigger 2 and the other end of the spring 11 with the inertia component 9.

The trigger 2 and the inertia component 3 are connected to one another in such a way that with sufficiently low acceleration the trigger 2 and the inertia component 9 are moved together like a rigid body. With excessive acceleration of the trigger 2, a relative movement takes place between the trigger 2 and the inertia component 9. Consequently, the inertia component 9 remains in its starting position. The knee lever is then deflected.

Due to the spring 12 the connection between the trigger 2 and the inertia component 9 is also elastic.

The inertia component 9 shown in FIG. 1 is solely held or stored by the connection to the trigger 2. There are therefore no other elements or components by means of which the inertia component 9 is held or stored.

The opening device comprises a blockade lever 13 which can be moved by deflection of the knee lever 10 from its starting position shown in FIG. 1 into its blocking position. If the blockade lever 13 is in its starting position shown in FIG. 1, the triggering lever 3 can be activated for an opening of the locking mechanism around its axis 4 in a clockwise direction.

The blockade lever 13 is L-shaped and demonstrates 2 arms 14 and 15 which are connected to one another at right angles. The long arm 14 is pivotably stored by an axis 16 and can be grasped and pivoted by the joint 17 of the knee lever 10. The other arm 15 can be blocked in such a way that activation of the triggering lever 3 is prevented for opening of the pertaining locking mechanism indirectly by the inertia component 9. The joint 17 connects the two arms of the knee lever 10 flexibly with one another.

The blockade lever 13 is pre-tensioned by a non-illustrated spring which can move the blockade lever against a stop 18 and can thus hold the blockade lever 13 in its starting position. The trigger 2 is pre-tensioned by a non-illustrated spring which can move the trigger 2 against a stop 19 and can thus hold the trigger 2 in its starting position. The triggering lever 3 is pre-tensioned by a non-illustrated spring which can move the triggering lever 3 against a stop 20 and can thus hold the triggering lever 3 in its starting position.

If the blockade lever 13 is in its blocking position, the triggering lever cannot be activated to open the locking mechanism. This is indirectly prevented by the blockade lever 13.

FIG. 2 illustrates activation of the opening device with low acceleration. Starting from the starting position in accordance with FIG. 1, the trigger 2 is shifted along the arrow 21. Due to the low acceleration the spring 12 and thus also the inertia component act as a rigid body. Consequently, the inertia component 9 is pushed along the arrow 22. A relative movement between the trigger 2 and the inertia component 9 therefore does not or practically does not take place. If the arm 7 of the trigger 2 has thus passed its empty path and reaches the arm 5 of the triggering lever 3, the inertia component 9 is moved out of its starting position and thus its blocking position. If the arm 7 of the trigger 2 is now pushed further along the arrow 21, the triggering lever 3 is pivoted around its axis 4 in a clockwise direction. The associated rotation of the arm 6 of the triggering lever 3 opens a pertaining locking mechanism.

FIG. 3 shows the effects in the case of excessive acceleration of the trigger 2 along the arrow 21. Due to the mass inertia of the inertia component 9 the spring 12 and the inertia component 9 do not act like a rigid body. Instead, the inertia component 9 remains in its blocking position.

The knee lever 10 is therefore deflected and the joint 17 is moved against the arm 14 of the blockade lever 13 after traversing an empty path. Subsequently, the blockade lever 13 is pivoted around its axis 16 in a clockwise direction until the arm 15 of the blockade lever 13 prevents a movement of the inertia component 9 parallel to the arrow 21. Furthermore, the arm 14 of the blockade lever 13 prevents the inertia component 9 from being deflected upwards and leaving its blocking position.

FIG. 3 illustrates that the angle which the two arms of the knee lever 10 include is decreased and is roughly 90° when the blocking lever 13 has reached its blocking position. FIG. 1 illustrates that this angle in the starting position is less than 180° and considerably greater than 90°.

If the triggering device is in the position shown in FIG. 3, the opening device must be returned to the starting position in order to be able to open a pertaining motor vehicle latch. This characteristic ensures in a particularly reliable manner that the motor vehicle latch cannot open inadvertently.

FIG. 4 shows a second opening device 1 for a locking mechanism of a motor vehicle latch. The second opening device 1 comprises a movable trigger 2, with which a non-illustrated locking mechanism of a motor vehicle latch can be opened. The trigger 2 can be moved in a linear manner from the starting position shown in FIG. 4 to an opening position and back in order to activate, i.e. pivot, the triggering lever 3 by movement into the opening position. The trigger 2 is pivotable.

The trigger lever 3 is stored pivotably around an axis 4 and demonstrates two arms 5 and 6. If the triggering device is activated, the trigger 2 is thus moved out of its starting position namely in the direction of the triggering lever 3. The trigger 2 comprises an arm 7, with which the triggering lever 3 can be pivoted around the axis 4 for an opening of the locking mechanism in an anti-clockwise direction. In the starting position shown in FIG. 4 there is an empty path between the arm 7 of the trigger 2 and the triggering lever 3 or its arm 6 for especially reliable operation. If the trigger 2 has been moved along the empty path 8 by activation, the free end of the arm 7 of the trigger 2 reaches the end of the arm 6 of the triggering lever 3. If an exceeding continuation of the movement of the trigger 2 is not blocked, the triggering lever 3 is then pivoted in an anti-clockwise direction. As a result of the associated pivoting of the other arm 5 of the triggering lever 3 a pertaining locking mechanism is then opened. Opening can occur by means of the arm 5 or the arm 6. Thus, the pivoting of the arm 6 of the triggering lever 3 for example can grasp a pawl of a pertaining locking mechanism and move it out of its locking position. Subsequently, the catch of the locking mechanism can be moved out of its locking position and the latch thus opened. Alternatively, the end of the arm 5 can grasp a pawl in order to move this out of its locking position by pivoting.

The trigger 2 is connected to an inertia component 9. The inertia component 9 preferably consists of a heavy material such as metal in order to provide sufficiently heavy weight with a small installation space. The form of the inertia component 9 can be very simple. An elongated body with rectangular and/or quadratic lateral surfaces is thus sufficient. The inertia component 9 in this configuration form preferably demonstrates a beveled end 23 which enables desired movement and blocking of the triggering lever 3 with a simultaneously small design in an improved manner. The beveled end 23 runs in a such a way that it includes a triangle with the two arms 7, 11 of the trigger 2.

In the starting position shown in FIG. 4 pivoting of the triggering lever 3 in an anticlockwise direction causes the arm 5 of the triggering lever 3 to be moved against the inertia component 9 preferably only after traversing of a short empty path shown in FIG. 4. The inertia component 9 then blocks a further pivoting of the triggering lever 3 in an anticlockwise direction and thus opening of a pertaining locking mechanism. Activation for opening of a locking mechanism is therefore not then possible. It is therefore necessary to move the inertia component 9 out of its blocking position shown in FIG. 4, which is simultaneously the starting position, in order to be able to open a locking mechanism. Such a movement out is only possible if the trigger 2 is moved with sufficiently low acceleration from its starting position in the direction of the triggering position, therefore in the direction of the triggering lever 3.

The connection between the trigger 2 and the inertia component 9 comprises a knee lever 10 which permits a relative movement between the trigger 2 and the inertia component 9. In the case of relative movement the knee lever 10 is deflected. One end of the knee lever 10 is flexibly connected with an arm 11 of the trigger 2 and the other end with the inertia component 9.

The connection between the trigger 2 and the inertia component 9 also comprises a spiral spring 12 which also permits a relative movement between the trigger 2 and the inertia component 9. One end of the spring 12 is connected to the arm 12 of the trigger 2 and the other end of the spring 11 with the inertia component 9.

The trigger 2 and the inertia component 3 are connected to one another in such a way that with sufficiently low acceleration the trigger 2 and the inertia component 9 are moved together like a rigid body. With excessive acceleration of the trigger 2, a relative movement takes place between the trigger 2 and the inertia component 9. Consequently, the inertia component 9 remains in its starting position. The knee lever 13 is then deflected.

Due to the spring 12 the connection between the trigger 2 and the inertia component 9 is also elastic.

The inertia component 9 shown in FIG. 4 is solely held or stored by the connection to the trigger 2. There are therefore no other elements or components by means of which the inertia component 9 is held or stored.

The opening device comprises a blockade lever 13 which can be moved by deflection of the knee lever 10 from its starting position shown in FIG. 4 into its blocking position. If the blockade lever 13 is in its starting position shown in FIG. 4, the triggering lever 3 can in principle be activated for an opening of the locking mechanism in an anticlockwise direction around its axis 4.

The blockade lever 13 is L-shaped and demonstrates 2 arms 14 and 15 which are connected to one another at right angles. The long arm 14 is pivotable by an axis 16 and can be grasped and pivoted by the joint 17 of the knee lever 10. The other arm 15 can be blocked in such a way that activation of the triggering lever 3 is prevented for opening of the pertaining locking mechanism indirectly by the inertia component 9.

If the blockade lever 13 is in its blocking position, the triggering lever cannot be activated to open the locking mechanism. This is indirectly prevented by the blockade lever 13.

FIG. 5 illustrates activation of the opening device with low acceleration. Starting from the starting position in accordance with FIG. 4, the trigger 2 is shifted along the arrow 21. Due to the low acceleration the spring 12 and thus also the inertia component 9 act as a rigid body. Consequently, the inertia component 9 is pushed along the arrow 22. A relative movement between the trigger 2 and the inertia component 9 therefore does not or practically does not take place. If the arm 7 of the trigger 2 has thus passed its empty path and reaches the arm 6 of the triggering lever 3, the inertia component 9 has been moved out of its starting position and thus its blocking position. If the arm 7 of the trigger 2 is now pushed further along the arrow 21, the triggering lever 3 is pivoted around its axis 4 in an anticlockwise direction. The associated rotation of the arm 5 or 6 of the triggering lever 3 opens a pertaining locking mechanism.

FIG. 6 shows the effects in the case of excessive acceleration of the trigger 2 along the arrow 21. Due to the mass inertia of the inertia component 9 the spring 12 and the inertia component 9 do not act like a rigid body. Instead, the inertia component 9 remains in its blocking position or starting position.

The knee lever 10 is therefore deflected and the joint 17 is moved against the arm 14 of the blockade lever 13 after traversing an empty path. Subsequently, the blockade lever 13 is thus pivoted around its axis 16 in a clockwise direction until the arm 15 of the blockade lever 13 prevents a movement of the inertia component 9 parallel to the arrow 21. Furthermore, the arm 14 of the blockade lever 13 prevents the inertia component 9 from being deflected upwards and leaving its blocking position.

REFERENCE SIGN LIST

1: Opening device
2: Trigger
3: Triggering lever
4: Axis of the triggering lever
5: Arm of the triggering lever
6: Arm of the triggering lever
7: Arm of the trigger
8: Empty path between trigger and triggering lever
9: Inertia component
10: Knee lever
11: Arm of the trigger
12: Spiral spring
13: Blockade lever
14: Arm of the blockade lever
15: Arm of the blockade lever
16: Axis of the blockade lever
17: Knee lever—joint connection
18: Stop for blockade lever
19: Stop for trigger
20: Stop for triggering lever
21: Movement direction for trigger
22: Movement direction for inertia component
23: Beveled end of the inertia component

The invention claimed is:

1. An opening device for a motor vehicle latch comprising:

a triggering lever;

a trigger which can be moved from a starting position of the trigger into an opening position of the trigger for a pivoting of the triggering lever from a starting position of the triggering lever into an opening position of the triggering lever;

an inertia component connected to the trigger by a deflectable knee lever; and a blockade lever which can be moved by deflection of the knee lever into a blocking position, wherein movement of the triggering lever into the opening position is prevented when the blockade lever is in the blocking position, wherein during excessive acceleration of the trigger, the knee lever is deflected and the blockade lever is moved into the blocking position, wherein the triggering lever cannot be moved into the opening position if the inertia component is in a starting position of the inertia component, and wherein the blockade lever, when in the blocking position, blocks the inertia component from moving out of the starting position of the inertia component.

2. The opening device in accordance with claim 1, wherein the trigger and the inertia component are elastically connected.

3. The opening device in accordance with claim 1, further comprising a spring between the trigger and the inertia component, the spring being attached by one end to the trigger and by the other end to the inertia component.

4. The opening device in accordance with claim 1, wherein the inertia component is solely held via being connected to the trigger.

5. The opening device in accordance with claim 1, wherein the trigger is stored in a linearly movable manner.

6. The opening device in accordance with claim 1, wherein the trigger comprises two arms, wherein one arm is connected to the inertia component and the other arm extends in the direction of the triggering lever.

7. The opening device in accordance with claim 6, wherein the two arms of the trigger are connected at a right angle to one another or at least approximately at a right angle.

8. The opening device in accordance with claim 1, wherein the blockade lever comprises two arms which are connected at a right angle to one another or at least approximately at a right angle.

9. The opening device in accordance with claim 1, wherein one arm of the blockade lever can be grasped and pivoted by the knee lever and another arm of the blockade lever can block to prevent movement of the triggering lever into the opening position.

10. The opening device in accordance with claim 1, wherein the trigger, the blockade lever and/or the triggering lever can be moved into a corresponding starting position by spring force.

11. The opening device in accordance with claim 1, wherein an empty path is defined between the knee lever and the blockade lever and/or between the trigger and the triggering lever.

12. The opening device in accordance with claim 1, wherein the knee lever comprises two arms joined together, whereby one arm is joined with the trigger and the other arm is joined with the inertia component.

13. A latch for a motor vehicle with an opening device in accordance with claim 1.

14. The opening device in accordance with claim 3, wherein the spring is a spiral spring.

15. An opening device for a motor vehicle latch with a trigger which can be moved from a starting position into an opening position for a pivoting of a triggering lever from a starting position into an opening position and which is connected with an inertia component by a deflectable knee lever, with a blockade lever, which can be moved by deflection of the knee lever from a starting position into a blocking position, whereby the movement of the triggering lever into the opening position is prevented when the blockade lever is in its blocking position, whereby the knee lever is deflected by excessive acceleration of the trigger and the blockade lever is thus moved into its blocking position, wherein an empty path is defined between the knee lever and the blockade lever and/or between the trigger and the triggering lever.

16. The opening device in accordance with claim 15, wherein the trigger and the inertia component are elastically connected.

17. The opening device in accordance with claim 15 further comprising a spring between the trigger and the inertia component, is the spring being attached by one end to the trigger and by the other end to the inertia component.

18. The opening device in accordance with claim 15, wherein the trigger is stored in a linearly movable manner.

19. The opening device in accordance with claim 15, wherein the trigger comprises two arms, wherein one arm is connected to the inertia component and the other arm extends in the direction of the triggering lever.

* * * * *